United States Patent [19]

Brown et al.

[11] 4,185,575

[45] Jan. 29, 1980

[54] RAMP SPEED INTEGRATED MOTOR CONTROLLER FOR SEWING MACHINES

[75] Inventors: Jack Brown, Union; John Herr, Garwood; Wesley R. Peterson, Bound Brook; John W. Wurst, Dover, all of N.J.

[73] Assignee: The Singer Company, New York, N.Y.

[21] Appl. No.: 16,056

[22] Filed: Feb. 28, 1979

[51] Int. Cl.[2] ..... D05B 69/18

[52] U.S. Cl. ..... 112/277; 318/778

[58] Field of Search ..... 112/277, 275, 121.11, 112/220; 318/778

[56] References Cited

U.S. PATENT DOCUMENTS

| | | | |
|---|---|---|---|
| 3,573,580 | 4/1971 | Shinozaki | 318/778 |
| 3,799,084 | 3/1974 | Furnari | 112/121.11 |
| 4,092,937 | 6/1978 | Landau, Jr. et al. | 112/121.11 |
| 4,150,634 | 4/1979 | Brown et al. | 112/275 |

*Primary Examiner*—Peter P. Nerbun

*Attorney, Agent, or Firm*—David L. Davis; Edward L. Bell; R. E. Smith

[57] ABSTRACT

A fixed speed sewing machine is disclosed having only start and stop control capability for the actual running of the machine. An arrangement is provided for controlling the acceleration of the sewing machine drive motor so that it is gradual, rather than abrupt.

6 Claims, 2 Drawing Figures

RAMP SPEED INTEGRATED MOTOR CONTROLLER FOR SEWING MACHINES

BACKGROUND OF THE INVENTION

This invention relates to sewing machines and, more particularly, to a sewing machine drive motor speed control system.

When operating a motor driven sewing machine, it is desirable to be able to start and stop the drive motor of the sewing machine while having both hands available for guiding the work piece being sewn. One way of accomplishing this objective is to provide a foot or knee operated motor controller wherein the speed of the sewing machine drive motor is controlled by controlling the amount of pressure applied to the controller.

An alternative to the above is fully disclosed in U.S. patent application Ser. No. 907,459, filed May 19, 1978, now U.S. Pat. No. 4,150,634 and assigned to the assignee herein. In the system disclosed in the referenced application, contact switches are provided in close proximity to the stitch forming location of the sewing machine. Means are provided for allowing the sewing machine operator to select an operating speed of the sewing machine drive motor and the sewing machine is operated at that speed when the operator applies hand pressure to the contact switch. Since the contact switch is in close proximity to the stitch forming location, the sewing machine operator may utilize both hands for guiding the work piece being sewn while at the same time controlling the operation of the sewing machine. A disadvantage of such a system is that the sewing machine operator may experience some inconvenience when sewing starts immediately at a fast speed. It would be preferable for the sewing machine drive motor to gradually increase in speed whenever the operator starts sewing.

It is therefore an object of this invention to provide a motor speed controller for fixed speed operation of a sewing machine wherein there is a gradual acceleration of the motor to the fixed operating speed.

SUMMARY OF THE INVENTION

The foregoing and additional objects are attained in accordance with the principles of this invention in a sewing machine having an electrically operable drive motor, a needle bar, an arm shaft including means for connecting the needle bar to the drive motor for endwise reciprocatory stitch forming motion of the needle bar toward and away from a stitch forming location, a contact switch disposed in close proximity to the stitch forming location and having an open position and a closed position, the contact switch being moved to the closed position by hand pressure of a sewing machine operator, and control means for connecting the drive motor to a source of electrical power in response to closure of the contact switch, the control means including operator influenced means for setting an operating speed for the drive motor, by providing ramp speed means interposed between the source of electrical power and the control means for gradually increasing the application of electrical power to the control means from an initial power level in response to closure of the contact switch so as to control a gradual acceleration of the drive motor to the operating speed.

In accordance with an aspect of this invention, there is further provided reset means responsive to the opening of the contact switch for restoring the ramp speed means to a condition wherein a subsequent closure of the contact switch causes power to be applied to the control means from the initial power level.

BRIEF DESCRIPTION OF THE DRAWINGS

The foregoing will be more readily apparent upon reading the following description in conjunction with the drawings in which like reference numerals in different figures denote like elements and wherein.

DETAILED DESCRIPTION

Figure 1:
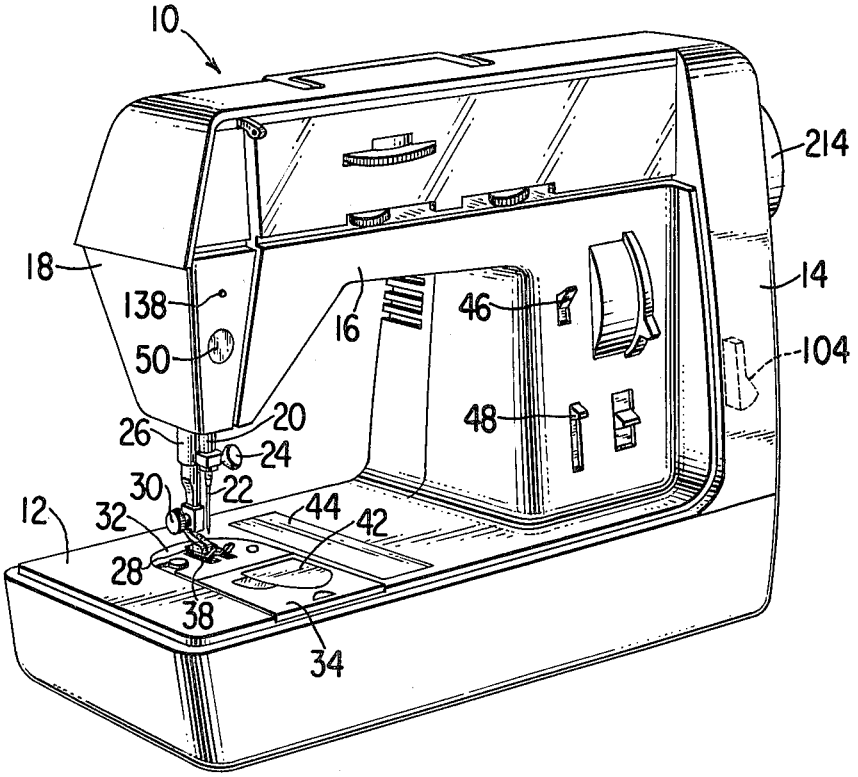
FIG. 1 is a perspective view of a sewing machine incorporating a controller constructed in accordance with the principles of this invention.

Referring to the drawing, FIG. 1 shows a conventional sewing machine 10 having a bed 12, a standard 14 rising from the bed 12, and an arm 16 overhanging the bed 12 and supported by the standard 14. The arm 16 terminates in a sewing head 18 having therein a needle bar 20 which is adapted for endwise reciprocatory stitch forming motion. The needle bar 20 has a needle 22 clamped thereto by a needle clamp 24. A presser bar 26 having a presser foot 28 removably attached thereto by a thumb screw 30 is also mounted in the head 18. A throat plate 32 and a bed plate 34 enclose a cavity formed in the bed 12. The presser foot 28 cooperates with a feed dog 38 which rises through a set of slots formed in the throat plate 32 and which moves fabric to be sewn relative to the endwise reciprocatory path of the needle 22. The region beneath the presser foot 28 is the stitch forming location of the sewing machine 10.

The needle bar 20 and the feed dog 38 are imparted motion in a conventional manner by an electrically operated motor 40 (FIG. 2) enclosed within the standard 14. Starting and stopping of the motor 40 is accomplished by pressure, or the lack thereof, respectively, applied to either of the contact plates 42, 44. Beneath each of the contact plates 42, 44 is a normally open switch which is closed with pressure from the sewing machine operator applied either directly to the contact plate or through the work piece being sewn. Each of the switches remains closed to complete an electrical circuit therethrough only as long as pressure is applied to the respective contact plate. Other controls on the sewing machine 10 include a needle up/down two position selector switch 46, a speed selection slide potentiometer having a control handle 48, and a reset button 50, the functions of which will be described in full detail hereinafter.

Figure 2:
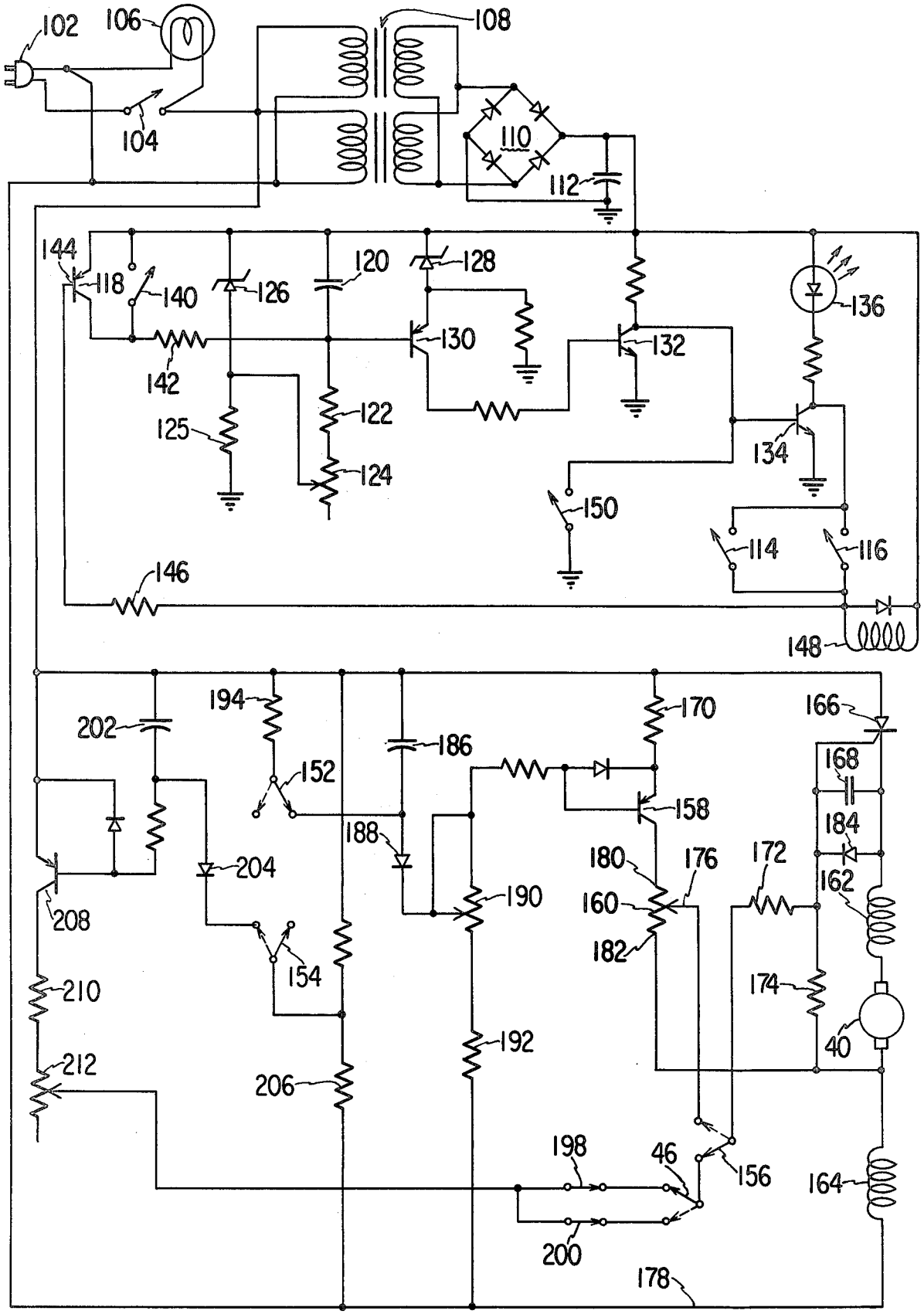
FIG. 2 is a schematic circuit diagram of an illustrative control system embodying the principles of this invention.

Referring now to FIG. 2, shown therein is a schematic diagram of circuitry for operating the sewing machine 10 (FIG. 1) in accordance with the principles of this invention. Commercially available power may be applied to the sewing machine via standard plug 102 and through an on/off two position switch 104. A lamp 106 may be provided for illuminating the fabric when the switch 104 is closed and the sewing machine is ready for operation. A transformer 108, diode bridge 110 and capacitor 112 provide a full wave rectified and filtered DC supply for logic circuitry which is employed as a safety device to prevent the accidental starting of the sewing machine after finger pressure has been released from a motor control contact plate for a fixed interval of time, but while the operator still has a hand in the stitch forming location, as for example while a work piece is being repositioned. As previously described, the operation of the sewing machine 10 is controlled by the operator selectively applying pressure to either of the contact plates 42, 44. Beneath each of the contact plates 42, 44, is a respective normally open contact switch 114, 116, which will be moved from its open positon to its closed position in response to pressure being applied to the respective one of the contact plate 42, 44.

When the operator releases pressure from one of the contact plates 42, 44, both of the switches 114, 116 are open and the transistor 118 stops conducting to allow the capacitor 120 to begin charging through the resistor 122, the potentiometer 124, and the resistor 125. The voltage to which the capacitor 120 is charged is determined by a zener diode 126, a zener diode 128 and the forward voltage drop across the base to emitter junction of the transistor 130. When the capacitor 120 is fully charged, the transistor 130 begins to conduct, turning on the transistor 132 which in turn turns off the transistor 134. This causes a light emitting diode 136 to be turned off. The light emitting diode 136 is visible through an aperture 138 in the sewing head 18 (FIG. 1). With the light emitting diode 136 extinguished, this indicates to the sewing machine operator that the sewing machine will not operate until reset by application of pressure to the reset button 50 on the sewing head 18.

Disposed behind the reset button 50 is a normally open contact switch 140. When the reset button 50 is pushed, the switch 140 is closed, which causes the capacitor 120 to discharge through the switch 140 and a resistor 142. When the capacitor 120 is discharged, the transistor 130 is turned off. With the transistor 130 turned off, the transistor 132 is turned off, turning on the transistor 134 and lighting the light emitting diode 136. Then, if one of the contact plates 42, 44 is pressed, closing one of the switches 114, 116, the base 144 of the transistor 118 is brought to a low potential through the resistor 146, the closed one of the switches 114, 116, and the collector to emitter path of the conducting transistor 134. The transistor 118 is then turned on, preventing the capacitor 120 from charging. At the same time, a conductive path is supplied for the relay coil 148 by the closed one of the switches 114, 116. Contacts associated with the relay coil 148 then apply power to the motor control circuit, as will be described in full detail hereinafter.

Further included in the reset logic circuitry is a normally open switch 150 coupled to the base of the transistor 134. The switch 150 is associated with the presser bar 26 (FIG. 1) and is closed when the presser bar is raised. This is a safety feature for the operator. The closure of the switch 150 turns off the transistor 134 and deenergizes the relay coil 148, taking power away from the motor control circuitry. At the same time, the transistor 118 is turned off, allowing the capacitor 120 to charge, resulting in the reset function being initiated.

It will be appreciated that the length of time during which the operator may stop sewing without having to operate the reset button 50 is controlled by the length of time that it takes to charge the capacitor 120, which may be adjusted by changing the resistance of the potentiometer 124.

The relay coil 148 controls three relay contact arms 152, 154 and 156, shown in FIG. 2 in the positions they assume with the relay coil 148 being deenergized. When the relay coil 148 is energized, the three contact arms 152, 154 and 156 move to the positions shown in phantom. Assuming for the time being that the sewing machine 10 is running, as will be described in full detail hereinafter, the transistor 158 is in a saturation condition, effectively providing a short circuit from its emitter to its collector, and the speed of the motor 40 is controlled by the setting of the potentiometer 160, the control handle 48 of which extends through the standard 14 of the sewing machine 10. The sewing machine drive motor, the armature winding of which is designated by the reference numeral 40, has field windings 162 and 164, and all three windings of the drive motor are serially connected to the cyclically varying power supply. Serially interposed between the power supply and the motor windings 40, 162 and 164 is a silicon controlled rectifier (SCR) 166. When triggered into conduction, the SCR 166 allows current to flow through the motor windings during the positive half cycles of the power supply.

To trigger the SCR 166 into conduction, there is provided a firing circuit which includes a charging capacitor 168 and a current control circuit comprising the resistors 170, 172 and 174, as well as the potentiometer 160. The charging capacitor 168 is connected across the gate and cathode of the SCR 166 and, as is well known in the art, when the voltage across the charging capacitor 168 reaches a predetermined threshold level, the SCR 166 is triggered into conduction. Within a positive half cycle of the power supply, the sooner the voltage across the charging capacitor 168 reaches that predetermined threshold value, the sooner the SCR 166 is triggered into conduction and the more current flows through the motor windings 40, 162 and 164. Therefore, to increase the motor speed, the charging capacitor 168 is charged more quickly so that the SCR 166 is triggered earlier in a positive half cycle and to drive the motor slower, the capacitor 168 is charged at a slower rate so as to trigger the SCR 166 at a later point in the positive half cycle.

The rate at which the capacitor 168 is charged is determined by the setting of the tap 176 of the potentiometer 160. The tap 176 is connected to the control handle 48. The charging path for the capacitor 168 is from the power supply, through the resistor 170, through the emitter to collector path of the transistor 158, through the potentiometer 160, through the relay contact arm 156, through the resistor 172, through the capacitor 168, through the drive motor windings 162, 40 and 164, and back to the power supply via the lead 178. Therefore, the closer that the tap 176 is to the end 180 of the potentiometer 160 the faster the charging rate of the capacitor 168 and the faster that the motor will run. Conversely, the closer that the tap 176 is to the end 182 of the potentiometer 160 the slower the charging rate of the capacitor 168 and the slower that the motor will run. During the negative half cycles of the power supply, the capacitor 168 discharges through the gate-cathode path of the SCR 166 and through the resistor 174, the armature winding 40 and the field winding 162. The diode 184 prevents excessive reverse voltage from appearing across the cathode-gate of the SCR 166.

The aforedescribed circuit is self-regulating in that prior to the firing of the SCR 166, as the armature winding 40 rotates through the residual magnetic field maintained by the iron in the field section of the motor, a back EMF is generated in opposition to the capacitor charging path which is directly proportional to the speed of rotation of the armature winding 40. This voltage on the armature winding 40 prior to firing the SCR 166 bucks the flow of charging current to the capacitor 20 and causes a longer time to elapse before the voltage across the capacitor 168 reaches the firing voltage of the SCR 166. This automatically retards the firing angle, allowing the motor to reach a stable equilibrium speed. If a load is now applied to the motor, its speed tends to decrease, reducing the residual induced voltage in the armature winding 40 and automatically advancing the firing angle. This increases motor torque to handle the increased load and maintains motor speed essentially constant.

In the foregoing description of the operation of the motor control circuitry, it was assumed that the transistor 158 was fully conductive. However, in accordance with the principles of this invention, circuitry is provided for controlling the conductivity of the transistor 158 to provide for a gradual, rather than an abrupt, acceleration of the motor when pressure is applied to one of the contact plates 42, 44. Accordingly, the maximum current that can flow from emitter to collector of the transistor 158 is controlled by the charging of the capacitor 186 through the diode 188, the trim potentiometer 190 and the resistor 192. Before pressure is applied to one of the contact plates 42, 44, the relay 148 is deenergized and the capacitor 186 is discharged through the resistor 194 and the relay contact arm 152. When pressure is initially applied to one of the contact plates 42, 44 and the relay coil 148 becomes energized, since the capacitor 186 is discharged, only a small amount of current is permitted to flow from the emitter to the base of the transistor 158, thus permitting only a small current to flow from the emitter to the collector of the transistor 158. This prevents triggering of the SCR 166 and the motor will not run. As the capacitor 186 charges to a higher voltage, progressively greater emitter to base current will flow in the transistor 158, thus permitting greater values of current to flow from the emitter to the collector of the transistor 158 causing triggering of the SCR 166 to occur earlier in each positive cycle of the power supply, and the motor will gradually accelerate. By adjusting the value of the trim potentiometer 190, the charging time of the capacitor 186 may be varied to control the time for the motor to reach its final speed, as determined by the setting of the potentiometer 160. It is noted that it requires less time for the motor to achieve its final speed if a lower speed is selected by the sewing machine operator.

If the operator desires to operate the sewing machine 10 at a speed lower than that selected via the potentiometer 160, for example at the start of a seam or in a critical sewing area, a "fluttering" of the contact plates 42, 44 will prevent the capacitor 186 from becoming fully charged. This prevents the transistor 158 from going into a saturation condition, thus keeping the motor speed below the selected speed.

Circuitry is also shown in FIG. 2 for stopping the sewing machine in a selected needle up or needle down condition in accordance with the setting of the switch 46 (FIG. 1). The two-position switch 46 has a contact arm which is positioned as shown in FIG. 2 for the needle up mode of stopping the sewing machine and is positioned as shown in phantom for the needle down mode of stopping the sewing machine. The position of the switch 46 determines which one of the two normally closed reed switches 198, 200 controls the stopping of the sewing machine. The reed switches 198, 200 are maintained closed by the fields of respective magnets. When the sewing machine armshaft rotates, a shutter attached thereto interrupts the magnetic fields to open the switches 198, 200 at the needle up and down positions, respectively. During the running of the sewing machine, the capacitor 202 is charged through the path including the diode 204, the contact arm 154 and the resistor 206. When there is a charge on the capacitor 202, the transistor 208 is in a condition for conduction. Then, when pressure is removed from the contact plates 42, 44, the relay coil 148 is deenergized and current is supplied to the charging capacitor 168 through the transistor 208, the resistor 210, the potentiometer 212, one of the normally closed reed switches 198, 200, the switch 46, the contact arm 156 and the resistor 172. When the desired up or down needle position is attained, the selected one of the switches 198, 200 opens and prevents any further firing of the SCR 168, bringing the motor to a stop. The potentiometer 212 is utilized to control the motor speed during this needle position seeking interval. The purpose of the capacitor 202 is to provide an upper time limit for this needle position seeking interval because the transistor 208 will provide a discharge path for the capacitor 202 and will only remain conductive until the capacitor 202 is discharged. Furthermore, if the operator turns the handwheel 214 (FIG. 1) after the machine has stopped and the capacitor 202 is discharged, the sewing machine will not start again to seek the desired needle position.

Accordingly, there has been disclosed an arrangement for providing gradual acceleration of a fixed speed sewing machine. This arragement provides certain advantages. For example, the operator is allowed time to establish proper control and guiding of the fabric, after which a faster speed may be desirable. Also, the arrangement allows the machine to be stopped rapidly soon after starting, if some error in stitching is deteched by the operator. Further, even if a high running sewing speed was pre-selected, the operator can work at an effective low speed in critical sewing areas by repetitively starting and stopping the motor while the speed is low. Additionally, the arrangement may reduce nonuniformity of starting stitches caused by transient changes in relative positions of various sewing machine parts at high acceleration. Further, no resetting of the speed setting is required to obtain a low speed for reverse locking stitches. Additionally, the arrangement allows time to change length and width of stitch patterns without making many stitches before the speed automatically rises.

It is understood that the above-described embodiment is merely illustrative of the application of the principles of this invention. Numerous other embodiments may be devised by those skilled in the art without departing from the spirit and scope of this invention, as defined by the appended claims.

We claim:

1. In a sewing machine having an electrically operable drive motor, a needle bar, an arm shaft including means for connecting said needle bar to said drive motor for endwise reciprocatory stitch forming motion of said needle bar toward and away from a stitch forming location, a contact switch disposed in close proximity to said stitch forming location and having an open position and a closed position, said contact switch being moved to said closed position by hand pressure of a sewing machine operator, and control means for connecting said drive motor to a source of electrical power in response to closure of said contact switch, said control means including operator influenced means for setting an operating speed for said drive motor, the improvement comprising:

ramp speed means interposed between said source of electrical power and said control means for gradually increasing the application of electrical power to said control means for an initial power level in response to closure of said contact switch so as to control a gradual acceleration of said drive motor to said operating speed.

2. The sewing machine according to claim 1 wherein said source of electrical power comprises a cyclically varying power supply, said control means includes a phase control circuit connected between said drive motor and said power supply, and a firing circuit coupled to said phase control circuit for phase firing said phase control circuit to supply power to said drive motor during a portion of the cycle of said power supply, and said ramp speed means includes means for controlling the flow of current to said firing circuit.

3. The sewing machine according to claim 2 wherein said ramp speed means includes a transistor having its emitter-collector path serially connected between said firing circuit and said power supply and means for controlling the conductivity of said transistor.

4. The sewing machine according to claim 3 wherein said conductivity controlling means includes a capacitor coupled to the base of said transistor and means for controlling the charging rate of said capacitor.

5. The sewing machine according to claim 4 wherein said ramp speed means further includes means for discharging capacitor in response to the opening of said contact switch.

6. The sewing machine according to claim 1 wherein the improvement further includes reset means responsive to the opening of said contact switch for restoring said ramp speed means to a condition wherein a subsequent closure of said contact switch causes power to be applied to said control means from said initial power level.

* * * * *